US012458100B2

(12) United States Patent
Swigart et al.

(10) Patent No.: US 12,458,100 B2
(45) Date of Patent: Nov. 4, 2025

(54) FOOTWEAR MIDFOOT SUPPORT SYSTEM

(71) Applicant: Acushnet Company, Fairhaven, MA (US)

(72) Inventors: John F. Swigart, Portland, OR (US); Jean-Marie Bidal, Bridgewater, MA (US); Robert S. Bento, Raynham, MA (US); Keith M. Duffy, Fairhaven, MA (US); Paul O. Teeter, Pembroke, MA (US)

(73) Assignee: ACUSHNET COMPANY, Fairhaven, MA (US)

( * ) Notice: Subject to any disclaimer, the term of this patent is extended or adjusted under 35 U.S.C. 154(b) by 130 days.

(21) Appl. No.: 18/066,847

(22) Filed: Dec. 15, 2022

(65) Prior Publication Data

US 2024/0197030 A1 Jun. 20, 2024

(51) Int. Cl.

| | |
|---|---|
| ***A43B 5/00*** | (2022.01) |
| ***A43B 7/14*** | (2022.01) |
| *A43C 11/14* | (2006.01) |
| *A43C 11/16* | (2006.01) |

(52) U.S. Cl.

CPC ..... *A43B 7/1495* (2013.01); *A43B 5/001* (2013.01); *A43C 11/1493* (2013.01); *A43C 11/165* (2013.01)

(58) Field of Classification Search

CPC ... A43B 7/1495; A43B 5/001; A43C 11/1493; A43C 11/165

USPC ..... 36/50.1

See application file for complete search history.

(56) References Cited

U.S. PATENT DOCUMENTS

| | | | | |
|---|---|---|---|---|
| 1,864,254 | A * | 6/1932 | Meyer | A43B 23/024 36/11.5 |
| 2,182,843 | A * | 12/1939 | Flynn | A43B 7/1495 36/170 |
| 3,678,604 | A * | 7/1972 | Levine | A43B 3/126 36/11.5 |
| 4,079,527 | A | 3/1978 | Antonious | |
| 4,451,995 | A * | 6/1984 | Antonious | A43C 11/002 36/51 |
| 4,547,981 | A | 10/1985 | Thais | |
| 5,317,820 | A | 6/1994 | Bell | |
| 5,381,609 | A | 1/1995 | Heblinger | |
| 5,408,761 | A | 4/1995 | Gazzano | |
| 5,651,197 | A | 7/1997 | James | |
| 5,659,982 | A | 8/1997 | Muraoka | |

(Continued)

*Primary Examiner* — Khoa D Huynh
*Assistant Examiner* — Giao QT Hoang
(74) *Attorney, Agent, or Firm* — Womble Bond Dickinson (US) LLP

(57) ABSTRACT

A golf shoe with a midfoot support system including a lateral strap extending from underfoot and over the midfoot region and a medial strap extending from underfoot inside the upper over the midfoot region. The medial strap extends outwardly from the upper material and is slidably engaged through the free end of the lateral strap. The free end of the medial strap may be engaged with an adjustable closure system to cinch the lateral and medial straps tightly around the midfoot. In some examples, the lateral strap includes a rigid support structure. The midfoot support system allows the foot to be stabilized within the shoe reducing movement of the foot within the shoe. This additional stability and prevention of movement as helpful during the golf swing and shot taking.

20 Claims, 7 Drawing Sheets

(56) References Cited

U.S. PATENT DOCUMENTS

| | | | | |
|---|---|---|---|---|
| 5,692,319 | A | 12/1997 | Parker et al. | |
| 5,692,320 | A | 12/1997 | Nichols | |
| 5,791,021 | A | 8/1998 | James | |
| 6,128,835 | A | 10/2000 | Ritter | |
| 6,393,733 | B1 * | 5/2002 | London | A43B 7/1495 36/170 |
| 7,343,701 | B2 | 3/2008 | Pare et al. | |
| 8,857,077 | B2 * | 10/2014 | Kahatsu | A43B 3/26 36/91 |
| 8,869,435 | B2 | 10/2014 | Hatfield et al. | |
| 8,991,014 | B2 | 3/2015 | Ivester et al. | |
| 9,220,318 | B2 | 12/2015 | James | |
| 9,375,052 | B2 | 6/2016 | Krueger | |
| 10,299,540 | B2 | 5/2019 | Bishop et al. | |
| 10,299,541 | B2 | 5/2019 | Bishop et al. | |
| 2008/0110048 | A1 | 5/2008 | Dua et al. | |
| 2008/0163515 | A1 | 7/2008 | Rackiewicz | |
| 2011/0239486 | A1 | 10/2011 | Berger | |
| 2012/0079741 | A1 | 4/2012 | Kohatsu | |
| 2013/0138028 | A1 | 5/2013 | Gerber | |
| 2016/0157561 | A1 | 6/2016 | Schum | |
| 2016/0324257 | A1 * | 11/2016 | Ko | A43B 13/145 |
| 2016/0366982 | A1 | 12/2016 | Chaney | |
| 2017/0035151 | A1 | 2/2017 | Peyton | |
| 2017/0065027 | A1 | 3/2017 | Hyde | |
| 2019/0069626 | A1 | 3/2019 | Kuefler | |
| 2020/0205522 | A1 | 7/2020 | Dombrow et al. | |
| 2020/0229543 | A1 | 7/2020 | Houng et al. | |
| 2020/0323309 | A1 | 10/2020 | Hanat | |
| 2021/0112922 | A1 | 4/2021 | Bock | |
| 2021/0368946 | A1 * | 12/2021 | Aoki | A43C 11/1493 |
| 2022/0031024 | A1 | 2/2022 | Cook | |
| 2022/0151342 | A1 | 5/2022 | Swigart | |

* cited by examiner

FOOTWEAR MIDFOOT SUPPORT SYSTEM

BACKGROUND

The sport of golf involves a variety of actions that a golfer may perform, such as a golf swing, walking a golf course, crouching down to line-up a putt, and other golfing actions. Having proper equipment when playing the sport of golf may be a factor in how well the golfer may be able to perform these actions. Footwear (i.e., shoes) are one example piece of equipment that can affect a golfer's performance. For example, when a golfer swings a club and transfers their weight on their feet, there are high forces placed on the golfer's foot. The shoe needs to provide a stable platform for the golfer when they make their swing, but the foot also needs to be able to flex to a certain degree. The bending of the shoe also is important when the golfer is walking, crouching down, and other golfing actions.

With respect to swinging a golf club, research reveals that providing lateral support at certain areas of the golfer's foot (e.g., rather than providing lateral support along the full length of the foot) provides sufficient lateral stability for the golfer's foot to increase the efficacy and quality of a golf swing. According to examples, between the ball of the golfer's midfoot and lateral malleolus is a critical zone for providing lateral support and stability for a golf swing.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe footwear (e.g., a golf shoe) comprising a midfoot support system. The midfoot support system may include a lateral strap extending from underfoot and over the midfoot region and a medial strap extending from underfoot inside the upper over the midfoot region. The medial strap extends outwardly from the upper material and is slidably engaged through the free end of the lateral strap. The free end of the medial strap may be engaged with an adjustable closure system to cinch the lateral and medial straps tightly around the midfoot. In some examples, the lateral strap includes a rigid support structure. The midfoot support system allows the foot to be stabilized within the shoe reducing movement of the foot within the shoe. This additional stability and prevention of movement is helpful during the golf swing and shot taking.

Examples include a golf shoe comprising: A golf shoe comprising: an upper; a sole connected to the upper at a bite line, the sole comprising an outsole and an insole, wherein the upper and sole each have a forefoot, midfoot, and heel regions, a lateral side, a medial side, an anterior end, and a posterior end; and a midfoot support system, comprising a lateral strap and a medial strap, wherein: the lateral strap is fixedly attached to the medial side of the outsole under a wearer's foot; the medial strap is fixedly attached to the lateral side of the insole under the wearer's foot; the lateral strap and the medial strap wrap around the wearer's foot and connect; tension of the midfoot support system can be increased and decreased; and when the tension of the midfoot support system is increased, the midfoot support system provides asymmetrical support of the wearer's foot by drawing the lateral side of the foot against the lateral side of the golf shoe.

Examples further include a golf shoe comprising: an upper; a sole connected to the upper at a bite line; a lateral strap, wherein: the lateral strap comprises a first end fixedly attached to a medial side of the sole; the lateral strap is connected to the sole from its first end to a lateral side of the sole; from the lateral side of the sole, the lateral strap extends outward from the bite line and upwards along a lateral side of the upper and over at least a portion of a midfoot region of the upper to a second end; and the second end of the lateral strap comprises a ring; a medial strap, wherein: the medial strap comprises a first end fixedly attached to the lateral side of the sole; from its first end, the medial strap extends under a wearer's foot to the medial side of the sole and upwards along a medial surface of the midfoot region of the upper; and a second end of the medial strap extends from the upper, through the ring of the lateral strap, and towards an exterior medial surface of the upper; and a tension adjustment element coupled to the second end of the medial strap such that adjustment of the tension adjustment element causes a pulling force on the second end of the medial strap that provides asymmetrical support of the wearer's foot by drawing a lateral side of the foot against a lateral side of the shoe.

Examples further include a golf shoe comprising: an upper; a sole connected to the upper at a bite line; a lateral strap made from a first material, the lateral strap comprising: a first end attached at least along a portion of a medial side of the sole; a second end extending from the bite line and upwards over a lateral side of a midfoot region of the shoe; and a support structure, positioned within the lateral strap, made from a second material that is more rigid than the first material, the support structure comprising: a lower portion located proximate to the first end of the lateral strap extending to the lateral side of the sole; and an upper portion extending from the lateral side of the sole upwards along a portion of the lateral side of the upper; and a medial strap comprising: a first end attached to a lateral side of the sole; and a second end extending under a wearer's foot to the medial side of the sole, upwards along an interior surface on a medial side of a midfoot region of the shoe, through the second end of the lateral strap, and back towards the medial side of the midfoot region.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

DETAILED DESCRIPTION

Figure 1A:
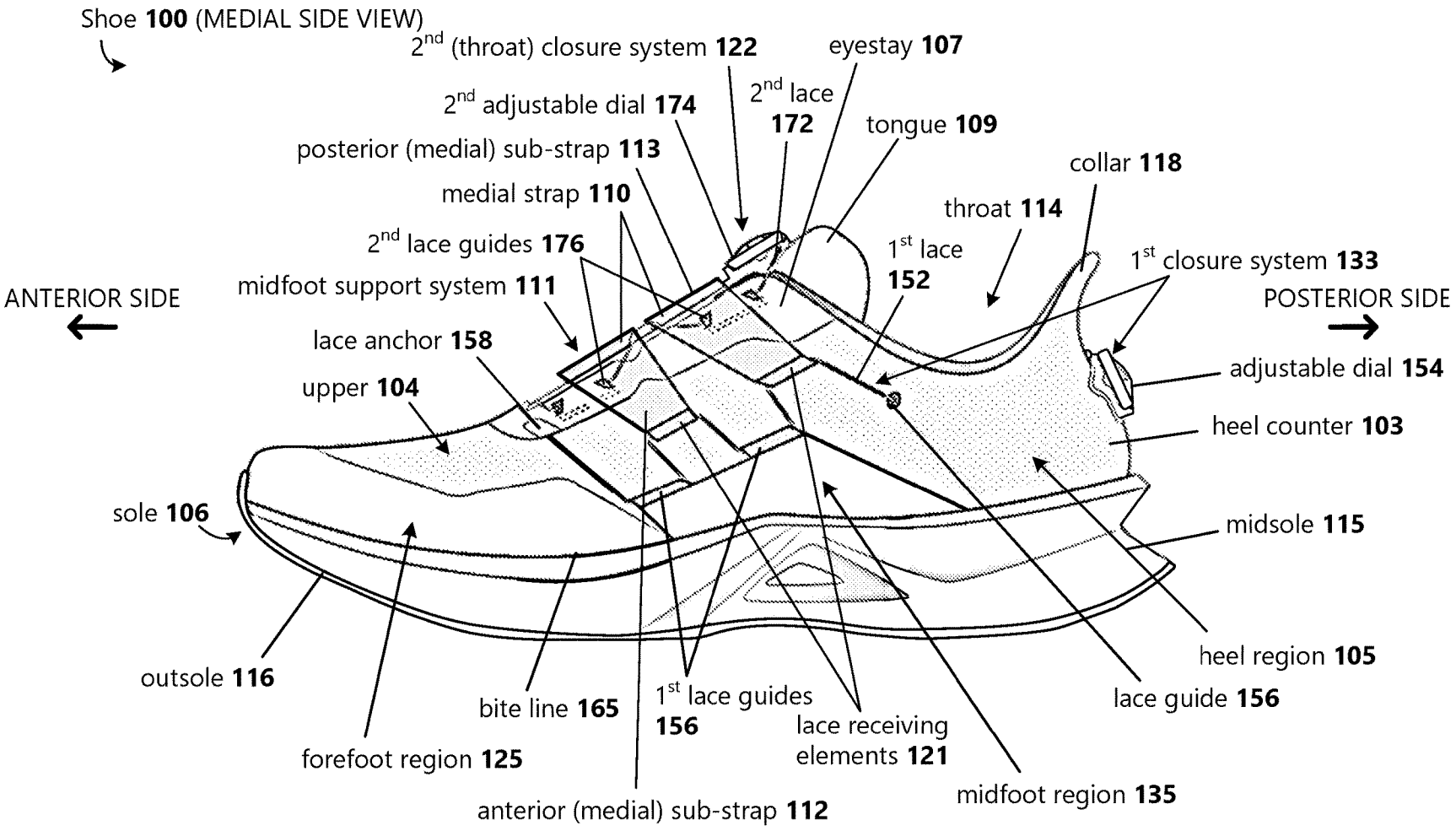
FIG. 1A depicts a medial side view of a golf shoe in which a midfoot support system may be implemented according to an example.

The present technology now will be described more fully in reference to the accompanying figures, in which embodiments of the technology are shown. However, this technology should not be construed as limited to the embodiments set forth herein. Rather, these embodiments are provided so that this disclosure will be thorough and complete, and will fully convey the scope of the technology to those skilled in the art. In the drawings, like numbers refer to like elements throughout. Thicknesses and dimensions of some components may be exaggerated for clarity. The views shown in the Figures are of a right shoe and it is understood the components for a left shoe will be mirror images of the right shoe. It also should be understood that the shoe may be made in various sizes and thus the size of the components of the shoe may be adjusted depending upon the shoe size.

The terminology used herein is for the purpose of describing particular embodiments only and is not intended to be limiting of the technology. As used herein, the singular forms "a," "an," and "the" are intended to include the plural forms as well, unless the context clearly indicates otherwise.

It will be understood that when an element is referred to as being "attached," "coupled" or "connected" to another element, it can be directly attached, coupled or connected to the other element or intervening elements may also be present. In contrast, when an element is referred to as being "directly attached," directly coupled" or "directly connected" to another element, there are no intervening elements present.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present technology are explained in detail in the specification set forth below.

When walking and playing golf, there are numerous and varied forces that may act on the foot and different parts of a golfer's footwear (e.g., shoe). Examples of the present disclosure describe a golf shoe comprising a midfoot support system that provides additional stability. For example, the reinforcement structure may aid the shoe in being able to hold and support the medial and lateral sides of the golfer's foot as they shift their weight while making a golf shot. Thus, the golfer has a stable platform to drive power for a golf swing while being able to stay balanced during the follow through of the golf swing. The midfoot support system may provide stability for various types of biomechanical movements. For example, the biomechanics associated with swinging a golf club call for a rapid shift of weight from back foot to front foot. Shear forces are applied to both feet through the swing. During the backswing, the back foot must remain stable. Improperly shifting weight at the back foot may result in improper contact with the ball. Further, due to biomechanics, the back foot may be susceptible to being rolled to the lateral outside or slipping from the initial foot placement. Weight transfer, thus, may be diminished and rotation may be lost. On the downswing, weight is shifted to the front foot, which must now remain relatively stable. Increasing foot stability may result in increasing the efficacy and quality of a golf swing.

According to examples, when the midfoot support system of a pair of shoes is engaged, the wearer's feet remain further secured within their respective shoe and are prevented from shifting while swinging the golf club. Thus, the feet are also more easily planted in position when the midfoot support system is engaged. During a backswing, the midfoot support system stabilizes the trail foot by reducing abduction and external rotation. Reducing abduction and external rotation of the back foot enables the user to place more load on the back hip leg muscle thereby enabling increased separation between the hips and shoulders prior to the downswing.

It is contemplated that the midfoot support system may stabilize a desired portion of the foot for a variety of activities, and there is no intention to limit the usefulness of the current disclosure. For example, the midfoot support system may stabilize at least a portion of a medial midfoot region for various activities.

Figure 1B:
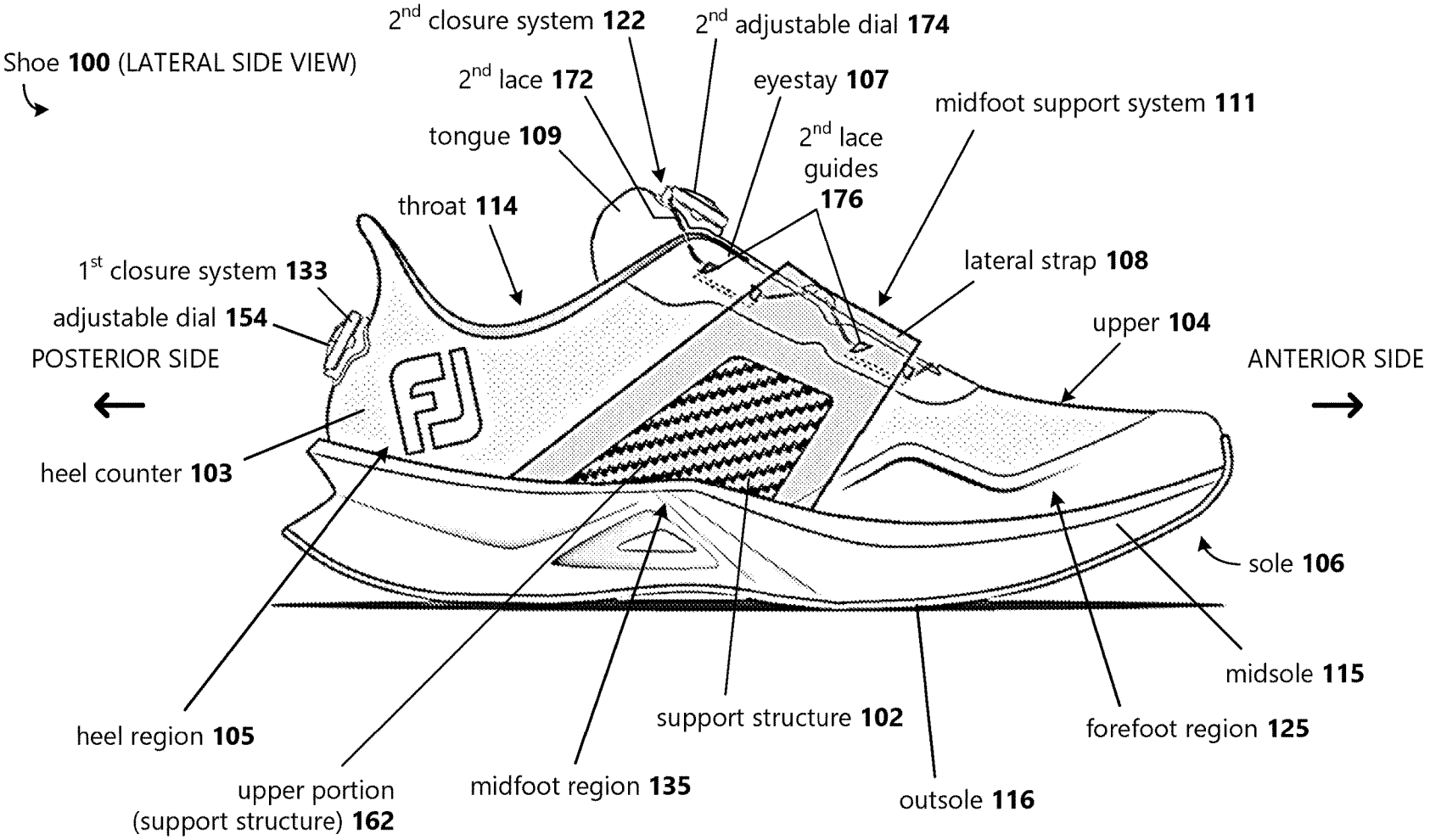
FIG. 1B depicts a lateral side view of the golf shoe of FIG. 1A according to an example.
Figure 1D:
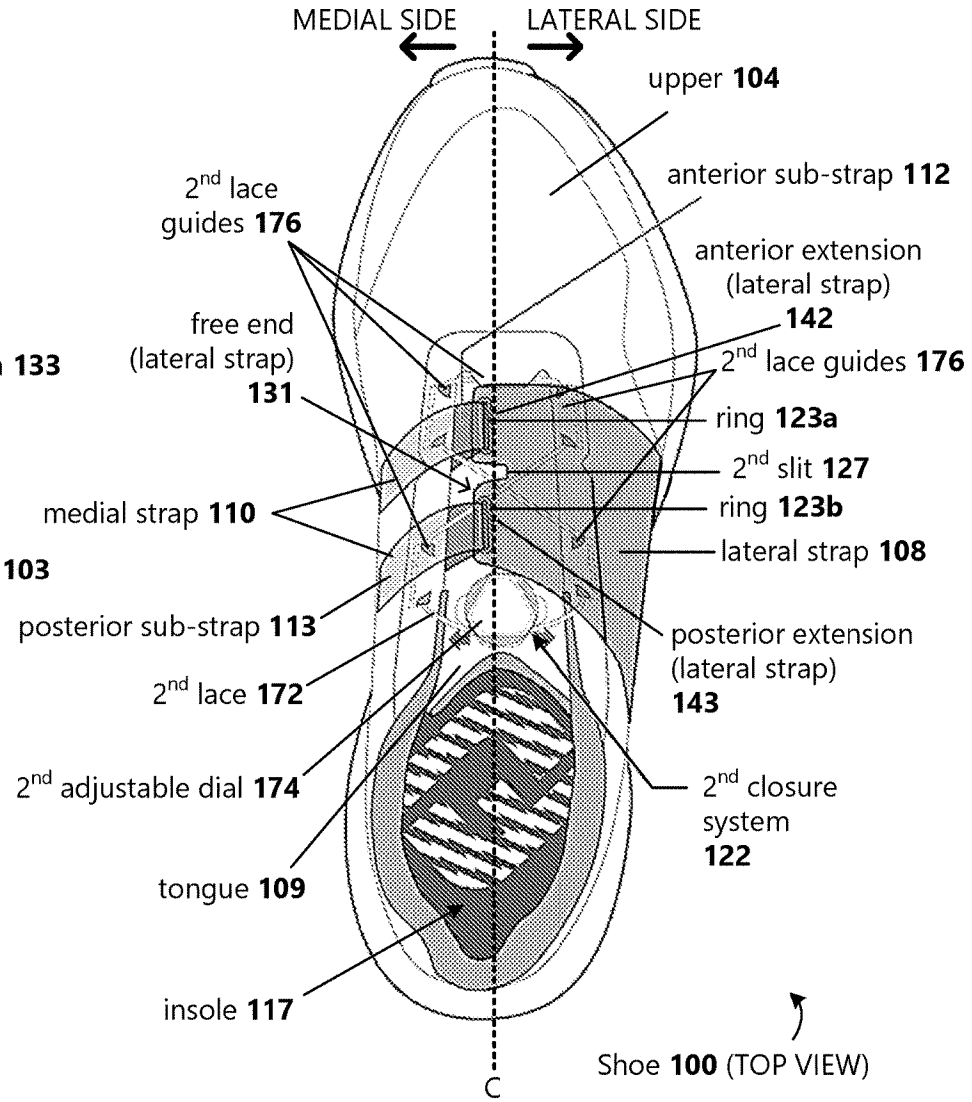
FIG. 1D depicts a top view of the golf shoe of FIG. 1A according to an example.
Figure 1C:
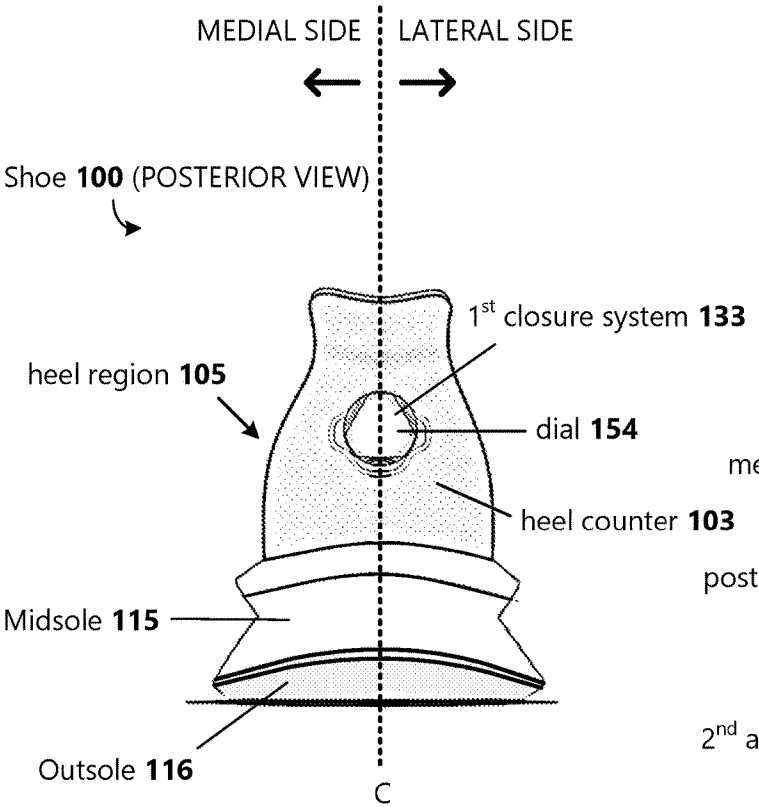
FIG. 1C depicts a posterior view of the golf shoe of FIG. 1A according to an example.
Figure 1E:
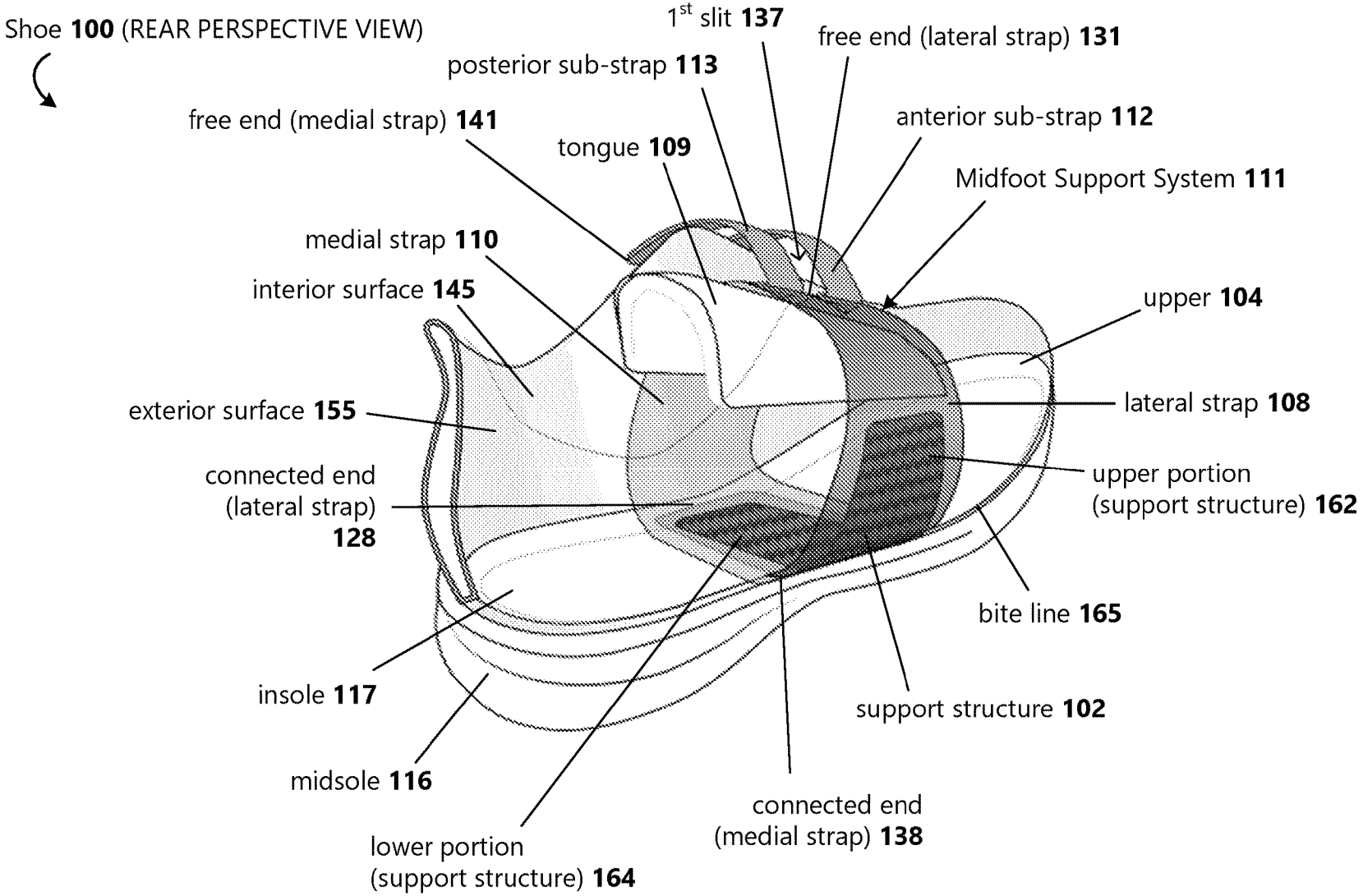
FIG. 1E depicts a rear perspective view of the golf shoe of FIG. 1A according to an example.

FIGS. 1A-1E include various views depicting an example golf shoe 100, sometimes referred to herein generally as a shoe, in which aspects of a midfoot support system 111 may be implemented. Various views of an example midfoot support system 111 are further depicted in FIGS. 2, 3, 4A, and 4B. FIG. 1A is a medial (e.g., inner) side view of the shoe 100 according to an example, FIG. 1B is a lateral (e.g., outer) side view of the of the shoe 100 according to an example, FIG. 1C is a rear view of the shoe 100 according to an example, FIG. 1D is a top view of the shoe 100 according to an example, and FIG. 1E is a rear perspective view according to an example. The shoe 100 may generally include a shoe upper 104 and a sole 106. As shown in FIG. 1, the shoe 100 includes a heel region 105, a midfoot region 135, a forefoot region 125, and the midfoot support system 111. According to examples, the midfoot support system 111 includes a closure system (a first closure system 133). In some examples, the shoe 100 includes a compound closure system including the first closure system 133 of the midfoot support system 111 and further including a second closure system 122.

The heel region 105 may generally correspond with the rear portions of a wearer's foot, namely, the area surrounding and below the Achilles tendon, the posterior of the heel, and the talus and calcaneus bones. A forefoot region 125 may generally correspond with a front of the wearer's foot, namely, the toes and metatarsal, phalange, and sesamoid bones. The midfoot region 135 may generally correspond with a middle of the wearer's foot, namely, the arch and the navicular, cuboid, and cuneiform bones. It is understood that the heel region 105, midfoot region 135, and forefoot region 125 are intended to represent general areas of footwear and not demarcate precise areas.

The shoe 100 has a medial side that extends from the forefoot region 125 to the heel region 105 and a lateral side that extends from a forefoot region 125 to the heel region 105. The lateral side and the medial side may be opposite one another. In some examples, the lateral side and medial side may be generally parallel to one another. The lateral side generally corresponds to an outside area of the wearer's foot and a surface that faces away from a wearer's other foot. The medial side generally corresponds to an inside area of the wearer's foot and a surface that faces toward the wearer's other foot. In examples, the medial and lateral sides may apply to the shoe 100 in general, and the medial side and lateral side may apply to each of the upper 104, sole 106, and other associated areas in reference or relation to a general longitudinal centerline C of the shoe 100.

As described herein, the heel region 105 is considered to be a posterior end of the shoe 100, and, conversely, the forefoot region 125 is considered to be an anterior end of the shoe 100. For example, the anterior end and posterior end may apply to the shoe 100 in general, and an anterior end and posterior end may apply to each of the upper 104, sole 106, and other associated areas in reference or relation to orientation toward the front or back of the shoe 100.

The upper 104 may have an interior surface 145 (shown in FIG. 1E) and an exterior surface 155 (also shown in FIG. 1E). The interior surface 145 may partially define an area configured to receive a wearer's foot. The upper 104 may be configured to extend over the wearer's foot, along the medial and lateral sides of the foot, and around a forefoot region and a heel region of the foot. The area configured to receive the wearer's foot may be accessed from an ankle opening (herein referred to as a throat opening or throat 114), which is defined by a collar 118. In some examples, the upper 104 includes an eyestay 107 in which eyelets may be defined and through which a lacing system may be threaded. In some examples, a tongue 109 is included and is located under the eyestay 107 and lacing system. For instance, the tongue 109 may contact the top of the wearer's foot.

The upper 104 may be constructed from any appropriate material now known or later developed, including, but not limited to, one or a combination of leather, suede, fabric, canvas, weaves, knits, man-made polymer fibers, nylon, polyester, or cotton. In some examples, the upper 104 may be elastic. Alternatively, at least a portion of the upper 104 may be elastic. In other embodiments, the upper 104 may be inelastic. In other examples, at least a portion of the upper 104 may be inflexible and is rigid or semi-rigid.

In some examples, the upper 104 may further include a heel counter 103 at the heel region 105. The heel counter 103 may reinforce the upper 104 and limit movement of the wearer's heel. The heel counter 103 may wrap around the heel region 105 and extend forward along both the lateral side and the medial side of the shoe 100.

The sole 106 may include an outsole 116, a midsole 115, and an insole 117 (shown in FIGS. 1D and 1E). The sole 106 may be coupled to the upper 104 at a bite line 165. The sole 106 may be configured to attenuate forces or provide support or cushioning. In some embodiments, the midsole 115 may be formed from a compressible material that provides cushioning. In other embodiments, the midsole 115 may include a structural support structure or be formed from dense materials to increase stability.

Figure 4A:
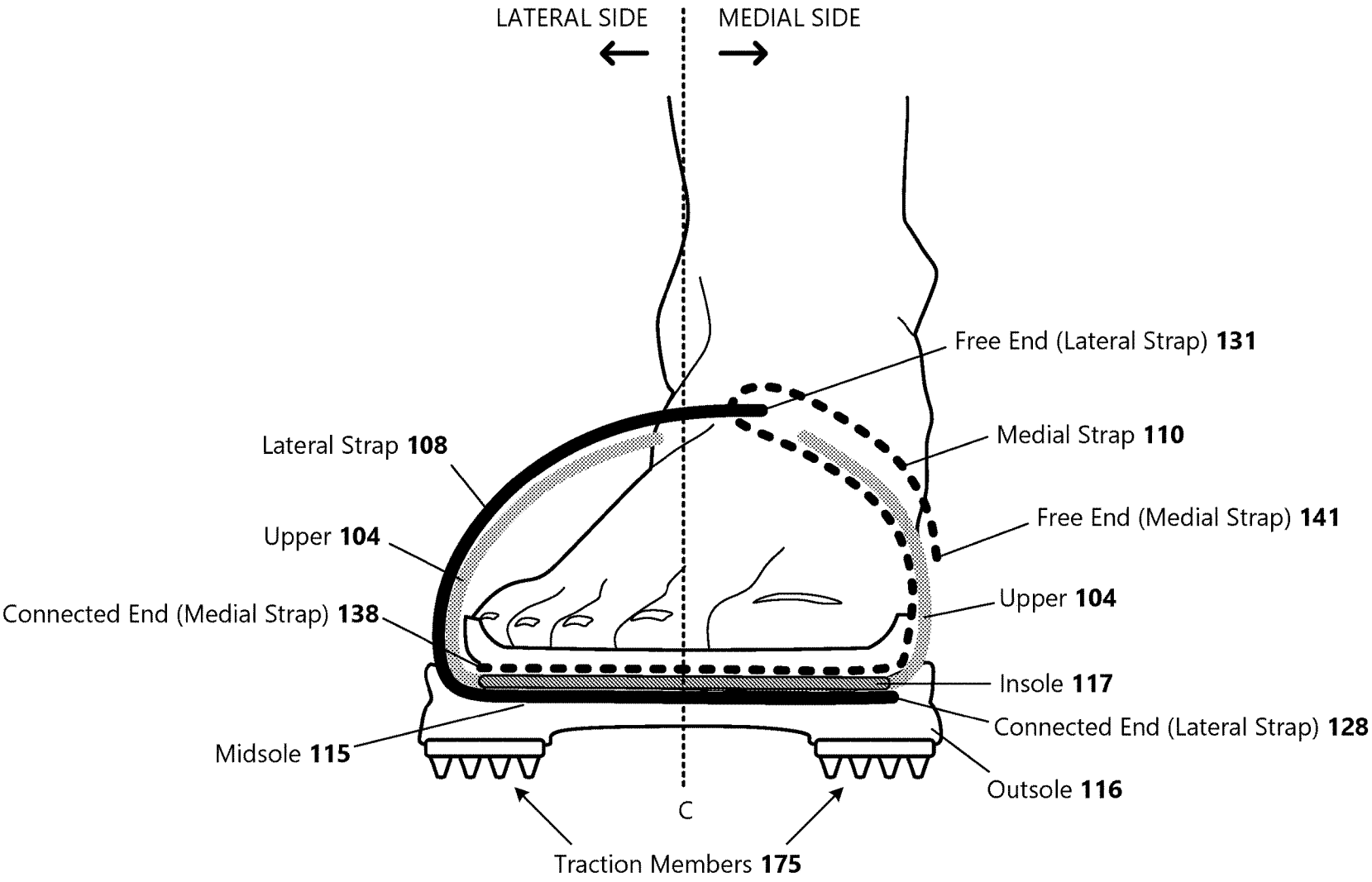
FIG. 4A depicts a front schematic view of the midfoot support system of FIG. 2 according to an example.
Figure 4B:
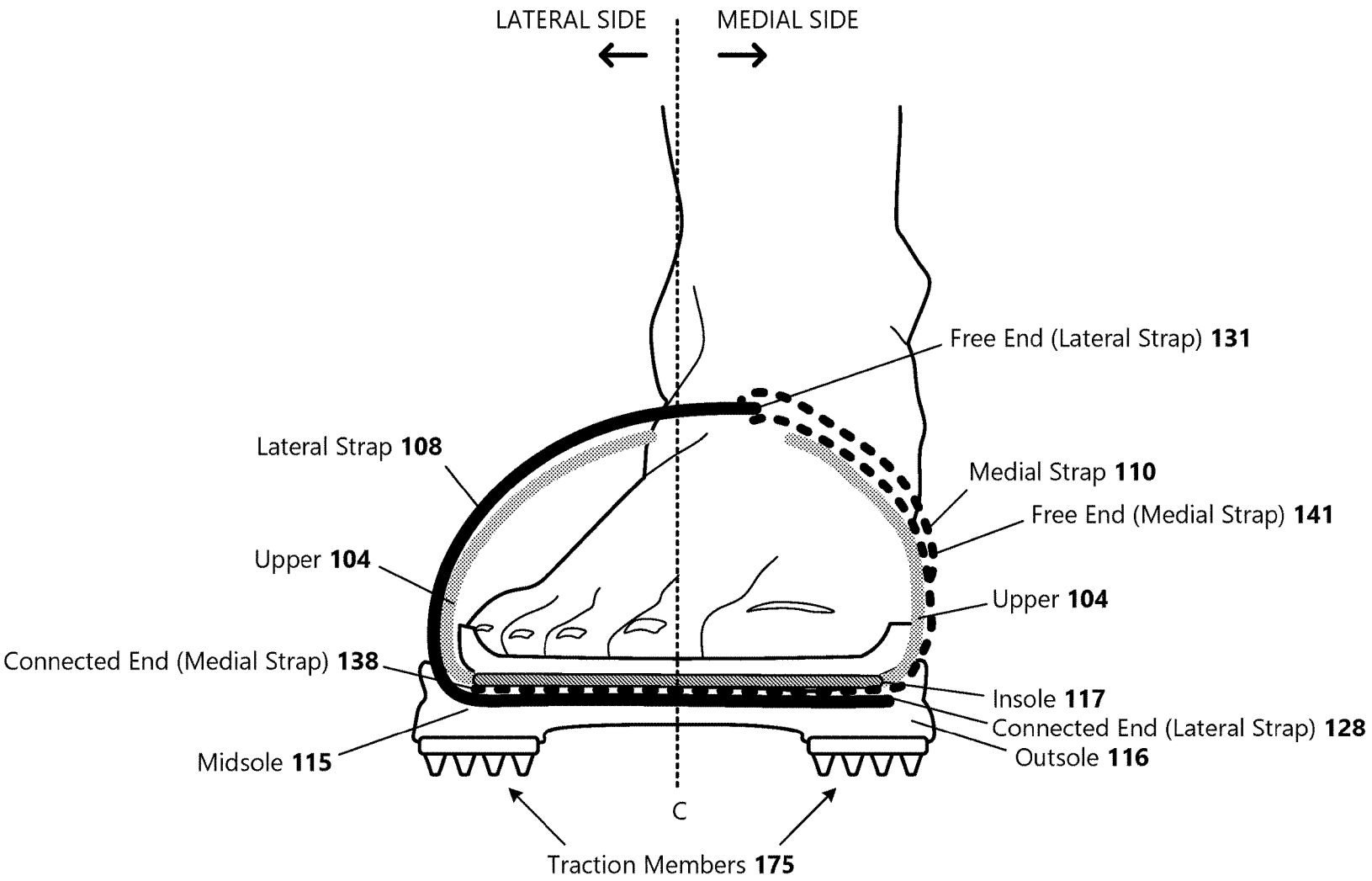
FIG. 4B depicts a front schematic view of a midfoot support system according to another example.

The outsole 116 may be below the midsole 115 and designed to interact with a ground surface. The outsole 116 may be designed to impart traction. In some examples, and as depicted in FIGS. 4A and 4B, traction members 175 (e.g., spikes, cleats, or other devices for additional traction) may be coupled to the outsole 116. Such traction members 175 may be releasably coupled to the outsole 116. In other examples, such traction members 175 may be fixedly coupled to the outsole 116. In some examples, the outsole 116 may be include multiple pads or ridges.

The insole 117 may be designed to provide cushioning or comfort for the wearer. The insole 117 may be removable and may be above the midsole 115 when in use. In some examples, the insole 117 may be designed to provide support. The insole 117 may be flexible, semi-rigid, or rigid.

In some example implementations, the midfoot support system 111 may be utilized at least in part to secure the upper 104 around the wearer's foot by pulling up slack of material of the upper 104 and surrounding and compressing around the wearer's foot to anchor the foot against a lateral edge of the shoe 100. According to examples, in addition to the first closure system 133, the midfoot support system 111 further includes two adjustment straps: a lateral strap 108 (shown in FIGS. 1B, 1D, 1E, 2, 4A and 4B) and a medial strap 110 (shown in FIGS. 1A, 1D, 1E, 2, 4A and 4B). The lateral strap 108 and the medial strap 110 may be formed from one or a combination of materials, such as leather, suede, fabric, canvas, weaves, knits, man-made polymer fibers, nylon, polyester, cotton, carbon fiber, thermosets, thermoplastics, or any appropriate material now known or later developed.

As best shown in FIG. 4A and according to an embodiment, the lateral strap 108 is fixedly attached to the sole 106 (e.g., between the midsole 115 and the insole 117 of the sole 106). In some examples, a first end of the lateral strap 108, which is referred to herein as a connected end 128, may be connected at or proximate to a medial edge of the insole 117 and/or the midsole 115. From its connected end 128, the lateral strap 108 may extend under the medial-lateral width of the midfoot region 135 to the lateral side of the bite line 165. In some examples, the lateral strap 108 may be fixedly attached to the insole 117 and/or midsole 115 along the entire medial-lateral width or substantially the entire medial-lateral width of the insole 117 and/or midsole 115. In other examples, the lateral strap 108 may be fixedly attached to the insole 117 and/or midsole 115 along only the medial edge of the insole 117 and/or midsole 115. In further examples, a portion of the lateral strap 108 may be recessed into the midsole 115.

The lateral strap 108 may further extend upwardly, from the bite line 165 on the lateral side of the shoe 100, along the outer lateral side of the upper 104, and over at least a portion of the midfoot region 135 of the upper 104. In In some examples, the connected end 128 of the lateral strap 108 is attached to the insole 117 or the midsole 115 by stitching, adhesives, or other suitable means and techniques to fixedly attach the lateral strap 108. The lateral strap 108 further includes a second end, which is referred to herein as a free end 131, that is configured to engage the medial strap 110. As will be described in further detail below, this engagement allows for a cinching and pulling of the lateral side of the wearer's foot against the lateral side of the shoe 100 to reduce movement and improve stability. This asymmetry in the shoe 100, for example, is desirable in the sport of golf. In particular, securing the wearer's foot against the lateral edge of the shoe 100 is ideal for swinging a golf club, where lateral stability is advantageous to efficacy and quality of a golf swing.

According to an embodiment, a first end of the medial strap 110, which is referred to herein as a connected end 138, is anchored to the shoe 100 at an anchor point under the lateral side of the wearer's foot. In some examples, the anchor point of the medial strap 110 may be located along the lateral side of the insole 117 or the midsole 115. In some examples, the anchor point of the medial strap 110 may be at or proximate to a lateral edge of the insole 117 or the midsole 115 (e.g., at or proximate to the bite line 165). In some examples, the connected end 138 of the medial strap 110 is attached to the insole 117 or the midsole 115 by stitching, adhesives, or other suitable means and techniques to anchor the medial strap 110.

From its connected end 138, the medial strap 110 may extend under the midfoot region 135, traversing medially across the wearer's arch on the medial side of the insole 117 or midsole 115 and wrapping upwards along the wearer's arch on the medial side and continuing across the wearer's instep (e.g., upper portion of the middle foot) and upwardly along the medial side of the upper 104 for connection with the lateral strap 108. In some examples, the medial strap 110 is fixedly attached to the shoe 100 only at the lateral edge of the insole 117 or the midsole 115, where the portion of the medial strap 110 that extends under the midfoot region 135 may be free-floating. In some examples, the medial strap 110 may wrap upwardly along the inner medial side of the upper 104 and then outwardly from the upper 104 for connection with the lateral strap 108. In other examples, the medial strap 110 may extend from the bite line 165 on the medial side of the shoe 100 and upwards along on the outer medial side of the upper 104 for connection with the lateral strap 108. According to examples, tension applied to the medial strap 110 causes the medial strap 110 to pull around the wearer's foot and up against the wearer's arch. Accordingly, the midfoot support system 111 provides 360-degree adjustment of the wearer's foot inside the shoe 100, allowing for adjustments geared toward the asymmetry of support advantageous for golf (e.g., securing the wearer's foot against the lateral side of the shoe 100). For instance, the 360-degree adjustment may include cinching and pulling the wearer's foot against the lateral side of the shoe 100, reducing movement of the foot and improving stability. In some examples, movement of the wearer's foot within the shoe 100 may be reduced by 5-6 mm. In other examples, the midfoot support system 111 may be configured to allow for adjustments geared toward a different asymmetry (e.g., securing the wearer's foot against the medial side of the shoe 100).

In some examples, a second end of the medial strap 110, which is referred to herein as a free end 141, may be slidably received through at least one ring 123*a*,123*b* (collectively, rings 123) defined in or attached to the free end 131 of the lateral strap 108. Each ring 123 may be sized to receive at least a portion of the medial strap 110 through an opening, allow it to pass through the ring 123, and double-back on itself.

According to some examples, the free end 141 of the medial strap may be engaged by the first closure system 133. The first closure system 133 can include one of various types of closure systems operative to engage the free end 141 of the medial strap 110 and apply tension to pull the medial strap 110 toward the medial side of the shoe 100. For example, when tension is applied and the free end 141 of the medial strap 110 is pulled, the medial strap 110 engages the lateral strap 108 and produces a cinching action that stabilizes a region of the shoe 100 and distributes the applied pressure over a desired area of the shoe 100. Although the first closure system 133 is depicted in FIGS. 1A-1D and described below as an adjustable lacing system (e.g., a BOA closure system of BOA Technology, Inc. described in U.S. Pat. No. 10,070,695, and incorporated herein by reference in its entirety), in other examples, the first closure system 133 may be implemented using another type of closure system, such as laces, buckles, ratchets, hook and loop fasteners, or other systems. Although the first closure system 133 is depicted as applying a pulling force to the medial strap 110 toward the medial side of the shoe 100, in other examples (not depicted), the first closure system 133 may be configured to apply a pulling force to the medial strap 110 toward the lateral side of the shoe 100. For instance, the medial strap 110 may be engaged by the first closure system 133 on the lateral side of the shoe 100.

In some examples, and as shown in FIGS. 1A, 1D, 1E, and 2, a first hole or slit 137 may be defined in the free end 141 of the medial strap 110. The first slit 137 splits a portion of the medial strap 110 into an anterior sub-strap 112 and a posterior sub-strap 113. For instance, the anterior sub-strap 112 and posterior sub-strap 113 of the medial strap 110 may be configured to move independently from one another to a degree in response to different pulling forces when the medial strap 110 is engaged.

In some examples, a lace receiving element 121 may be defined in or attached to the free end 141 of each of the anterior sub-strap 112 and the posterior sub-strap 113. For example, the lace receiving elements 121 may be sized to receive a first lace 152 of the first closure system 133 through an opening and allow the first lace 152 to pass through the lace receiving elements 121. In some examples, the openings of the lace receiving elements 121 are low friction. As shown in FIG. 1A in some examples, a portion of the first lace 152 may be above the upper 104 and configured to interact with the outer surface of the upper 104. In some examples, the lace receiving elements 121 of the medial strap 110 may be configured to prevent the first lace 152 from being in direct contact with the upper 104 at the position of the lace receiving elements.

In some examples, and in the example shoe 100 depicted in FIG. 1D, a second slit 127 may be defined in the free end 131 of the lateral strap 108. The second slit 127 splits a portion of the lateral strap 108 into an anterior extension 142 and a posterior extension 143. For instance, the anterior extension 142 and the posterior extension 143 of the lateral strap 108 may be configured to move independently from one another to a degree in response to different pulling forces and pull angles caused in part by engagement, at the rings 123, with the anterior sub-strap 112 and posterior sub-strap 113 of the medial strap 110.

According to examples, the lateral strap 108 may be of various shapes. According to one example, the connected end 128 of the lateral strap 108 may be shaped in a general contour of a middle of a foot, namely, the arch. In some examples, the lateral strap 108 may include two rings 123 that are configured to receive and allow the anterior sub-strap 112 and the posterior sub-strap 113 of the medial strap 110 to pass through. In some examples, each of the anterior sub-strap 112 and posterior sub-strap 113 may be received from a bottom side of the ring 123 and fold transversely of its length and back on itself to attach to the first closure system 133.

In the examples depicted, the rings 123 are shown as being positioned substantially above the throat of the shoe 100 when the first closure system 133 is at low or no tension. In other examples, the lengths of the lateral strap 108 and the medial strap 110 may be differently configured such that the rings 123 are positioned at different locations about the shoe 100. For instance, the lateral strap 108 may have a shorter length than depicted, and the rings 123 may be positioned more on the lateral side of the shoe 100. Positioning the rings 123 in such a manner changes the closure or pulling force directions when the medial strap 110 is tightened. For instance, the pulling forces may be more vertical. In other examples, the lateral strap 108 may be longer than depicted and the rings 123 may be positioned on a medial side of the shoe 100. This different position also changes the pulling forces.

In some examples, the first closure system 133 may include the first lace 152 mentioned above, a first adjustable dial 154, and first lace guides 156. In other examples, the first closure system 133 may not utilize the first adjustable dial 154 to control the tension of the first lace 152, and the tension may be increased, decreased, and/or secured by other means, such as a tied lace, an elasticized lace, a buckle, a ratchet, a hook and loop fastener, or other ways now known or later developed. Increasing the tension may result in a tightening of the first lace 152 and decreasing the tension may result in a loosening of the first lace 152. In some examples, the first lace 152 may be a tensile lace. In other examples, the first lace 152 may be a wire.

The first lace guides 156 may be coupled to the upper 104 at positions that enable the wearer to secure the upper 104 to their foot. The first lace guides 156 may be strategically placed such that when tightened, the first lace 152 does not cause a user discomfort. The placement of the first lace guides 156 may assist in stabilizing the foot. In some of the examples, the first closure system 133 and placement of the first lace guides 156 may attenuate forces acting on the wearer's foot, such as pressure, shear force, ground forces, or the ability for flexion or movement. The first lace guides 156 may be openings that allow the first lace 152 to slide through the opening when tension is increased or decreased, for example, using the first adjustable dial 154. In some examples, the first lace guides 156 are low friction. For instance, the interior surfaces of the first lace guides 156 that contact the first lace 152 may be made from a lower friction material than the outer surfaces that do not contact the first lace 152. The first lace guides 156 may be attached to the shoe 100 on the medial side of the upper 104.

In the example shown in FIG. 1A, the first lace guides 156 are located between the eyestay 107 and the bite line 165. In some examples, the first lace 152 may be coupled at a first end to a lace anchor 158 and at a second end to the first adjustable dial 154. The lace anchor 158 may be coupled to the shoe 100 at or proximate the eyestay 107. In the depicted example, the lace anchor 158 is located on the anterior-medial side of the eyestay 107. In some examples, the lace anchor 158 is fixedly coupled to the shoe 100. According to examples, the first lace guides 156 may be generally located along the medial side of the upper 104 to guide the first lace 152 posteriorly to the first adjustable dial 154.

According to examples, the first lace guides 156 may be positioned, such that when the first lace 152 is tightened, the increased tension of the first lace 152 exerts a pulling force on the free end 141 of the medial strap 110 (e.g., the free ends of the anterior sub-strap 112 and the posterior sub-strap 113). As described above, the medial strap 110 is engaged with the free end 131 of the lateral strap 108, wraps around the wearer's arch, and is anchored to the lateral edge of the shoe 100 below the wearer's foot. Additionally, in some examples, the medial strap 110 may only be attached at the lateral edge of the bite line 165, where the remainder of the medial strap 110 may be free-floating. Thus, when tension is increased in the medial strap 110, the medial strap 110 may be pulled around the wearer's foot and up against the arch of the foot. Additionally, the lateral strap 108 wraps below the wearer's foot and is attached to the upper surface of the midsole 115 of the shoe 100. Thus, increased tension of the first lace 152 may cause increased tension in the medial strap 110, and further cause the medial strap 110 to engage and pull the lateral strap 108 inwardly toward the medial side of the shoe 100 and tightly around the midfoot region 135 to secure the upper 104 around the wearer's foot. In some examples, engaging the lateral strap 108 prevents the foot from linearly sliding medio-laterally within the shoe 100. In some examples, the pulling force applied to the medial strap 110 by the first closure system 133 may cause the midfoot support system 111 to compress around the wearer's foot and further cause the midfoot support system 111 to index the lateral strap 108 against the wearer's foot, which may anchor the wearer's foot against a lateral edge of the shoe 100 for stabilizing and reducing horizontal movement of the foot. As will be described in further detail below, in some implementations, the lateral strap 108 includes a support structure 102 to increase lateral support and stability of the midfoot support system 111. For instance, a first pull force vector may be applied inside the shoe 100 that manipulates the wearer's foot to the lateral side of the upper 104, and a second pull force vector may cross the first pull force vector. The second pull force vector may be applied on the outside of the lateral side of the wearer's foot by a rigid support structure 102.

In some examples, the pulling force applied to the medial strap 110 may further cause the midfoot support system 111 to take up slack and airspace under the wearer's foot by drawing the insole 117 against the foot. For instance, the pulling force may cause the midfoot support system 111 to take up air space or volume within the shoe 100. Some volume may be due in part to an enlarged throat 114 opening to facilitate placement of a foot within the upper 104 of the shoe 100. In some examples, some shoes 100 have increased volume due in part to increased widths to accommodate for wider foot sizes.

As shown in FIG. 1A in some examples, a portion of the first lace 152 may be above the upper 104 and configured to interact with the outer surface of the upper 104. In other examples, the first lace guides 156 may be placed such that the first lace 152 is not in direct contact with the upper 104. In some examples, the first lace 152 may be at least partially visible. In some examples, a portion of the first lace 152 may be between an exterior surface of the upper 104 and an interior surface of the upper 104. In such embodiments there may be a channel for the laces between the exterior and the interior surfaces of the upper 104. The exterior and the interior surfaces of the upper 104. As shown in FIGS. 1A-1C, in some examples, the first adjustable dial 154 may be at the posterior end of the shoe 100 at the heel region 105. In some examples, the first adjustable dial 154 may be generally halfway between the collar 118 and the bite line 165.

According to an example implementation and as depicted in FIG. 1A, the first lace 152 may be attached at the lace anchor 158 and be slidably received through a first-first lace guide 156. The first-first lace guide 156 may be located below and posterior to the lace anchor 158. The first lace 152 may be further slidably received through a first lace receiving element 121 located on the anterior sub-strap 112 of the medial strap 110. The first lace receiving element 121 may be located above and posterior to the first lace guide 156. The lace 152 may be further slidably received through a second first lace guide 156. The second first lace guide 156 may be located posterior to the first-first lace guide 156. In some examples, the second first lace guide 156 may be located above the first-first lace guide 156 and below the first lace receiving element 121. The first lace 152 may be further slidably received through a second lace receiving element 121 located on the posterior sub-strap 113 of the medial strap 110. The second lace receiving element 121 may be located above and posterior to the first lace receiving element 121. The first lace 152 may be further slidably received through a third first lace guide 156 located posterior to the second first lace guide 156. In some examples, the third first lace guide 156 may be located above the second first lace guide 156 and below the second lace receiving element 121. The first lace 152 may further be attached at its second end to the first adjustable dial 154. In other example implementations, the positions of the first lace guides 156 and lace anchor 158 may vary.

While the depicted examples show a single adjustment element (e.g., the first adjustable dial 154) for pulling or otherwise adjusting the tension on the posterior sub-strap 113 and the anterior sub-strap 112, in other examples the tensions on the posterior sub-strap 113 and the anterior sub-strap 112 may be separately controlled or adjusted through an additional tension adjustment element (not depicted). In such examples, a first adjustment element is provided for adjusting the tension on the posterior sub-strap 113 and a second adjustment element is provided for adjusting the tension on the anterior sub-strap 112. The adjustment elements may be the same type or different types. For instance, the adjustable dial 154 may be used to adjust tension on one sub-strap, and a second type of adjustment element may be used to adjust tension on the other sub-strap. In some examples, a first ratchet may be used for adjusting tension on the anterior sub-strap 112 and a second ratchet may be used for adjusting tension on the posterior sub-strap 113. In yet other examples, one of the posterior sub-strap 113 and the anterior sub-strap 112 may be fixed to the outer/exterior surface 155 of the upper 104 and tension may be adjusted for the other sub-strap. In such examples, the fixed sub-strap may be at least partially elastic to assist in the golfer putting on the shoe 100.

Figures 2, 3:
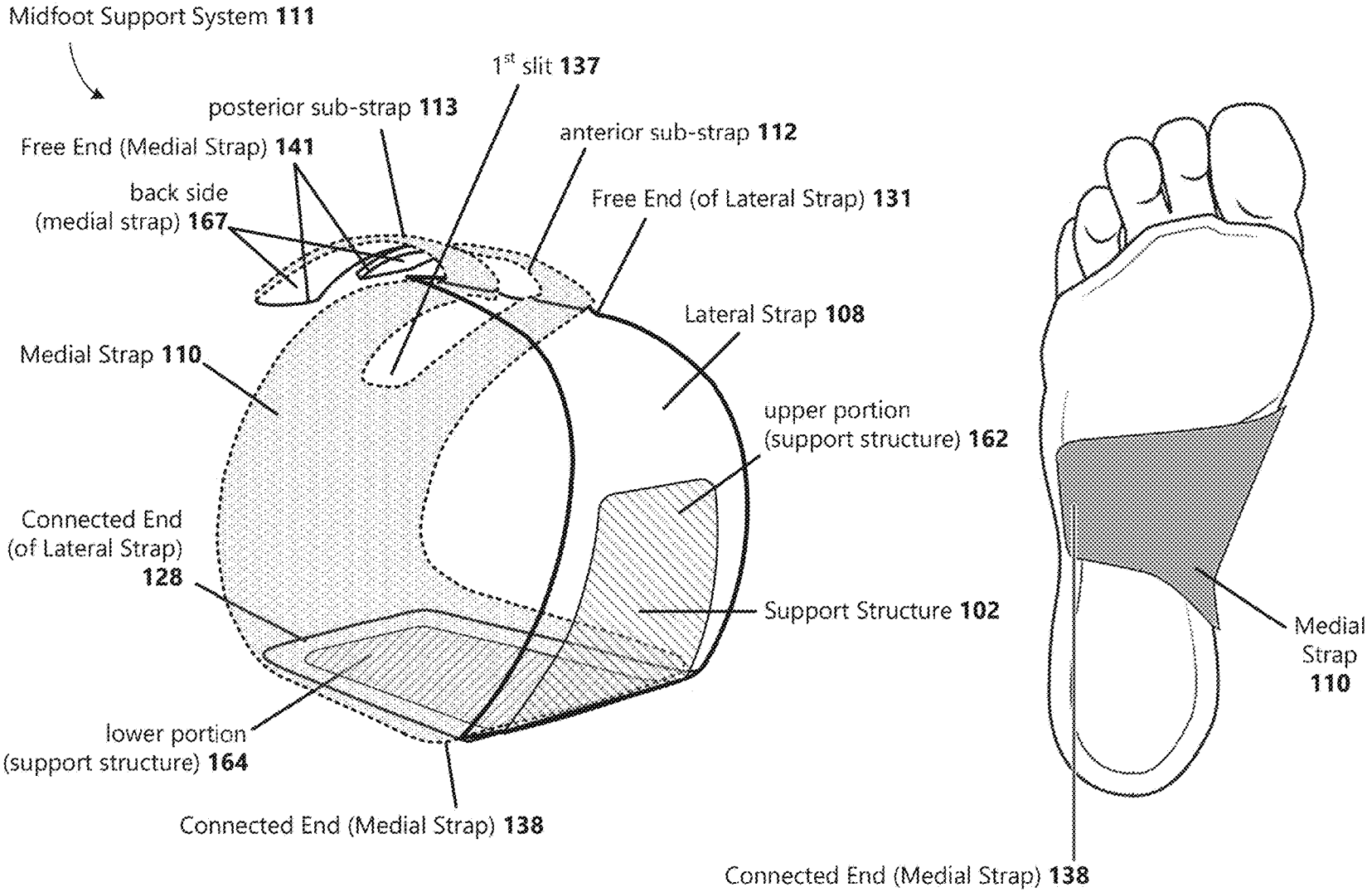
FIG. 2 depicts a rear perspective view of a midfoot support system according to an example.
FIG. 3 depicts a bottom view of a medial strap of the midfoot support system of FIG. 2 according to an example.

In some embodiments, and as best depicted in FIGS. 1B, 1E, and 2, the lateral strap 108 may include a support structure 102. The support structure 102 may be rigid or semi-rigid. For instance, the support structure 102 is more rigid than the material used for lateral strap 108. The amount of stabilization provided by the support structure 102 may vary depending on its rigidity, wherein increased rigidity may provide higher stabilization effects. In some examples, the support structure 102 is fixedly attached to the sole 106 (e.g., to the midsole 115) and is generally L-shaped. For instance, the support structure 102 may be located within the lateral strap 108 such that a lower portion 164 of the support structure 102 may be located at or proximate to the connected end 128 of the lateral strap 108 and extend under the midfoot region 135 and to the lateral edge of the insole 117, where it then extends upward along a portion of the outer lateral side of the upper 104. In some examples, the upper portion 162 of the support structure 102 is curved inwardly toward the medial side of the shoe 100. For instance, the inward curve of the upper portion 162 of the support structure 102 may be shaped so as to generally fit a contour of the outer lateral side of a wearer's midfoot. The support structure 102 may have a width that is generally uniform throughout the support structure 102. Alternately, the support structure 102 may have a variable width to provide increased stability. In some examples, the width of the support structure 102 may be wider proximate the bite line 165 and taper as it extends toward an uppermost point of the upper portion 162. According to examples, the support structure 102 may provide a higher level of rigidity to the lateral strap 108, and therefore to the midfoot support system 111 and the shoe 100. For example, when the midfoot support system 111 is engaged and the wearer is taking a stance, the wearer's feet may be anchored and locked in against the rigid lower portion 164 and upper portion 162 of the support structure 102.

The support structure 102 may be formed from carbon fiber, thermosets, thermoplastics, or any appropriate material now known or later developed with suitable rigidity. In some embodiments, the support structure 102 comprises a self-reinforced polymer composite material. Self-reinforced polymer composites are generally known in the composite industry and refer to fiber-reinforced composites comprising reinforcing fibers and a polymer matrix, where the highly oriented reinforcing fibers are made from the same polymer in which the matrix is made. For example, a polypropylene matrix can be reinforced with polypropylene fibers.

In some examples, the support structure 102 may be pre-molded into one of various sizes and shapes. For example, one or a combination of the width, length of the lower portion 164, and the height and curvature of the upper portion 162 of the support structure 102 may vary based on a shoe size, whether the shoe 100 is designed for a male, female, or youth foot, whether the shoe 100 is designed for a narrow, regular, or wide foot, and other factors. In some examples, the curvature of the upper portion 162 of the support structure 102 may be custom fit/molded to a wearer's foot. In some examples, the support structure 102 may be made of a heat moldable or thermoformable material that allows a wearer to custom-fit or mold the support structure 102 to the wearer's foot post-purchase.

The support structure 102 may be attached to the lateral strap 108 by stitching, adhesives, or other suitable means and techniques to incorporate the support structure 102 into the lateral strap 108. The support structure 102 may be further attached to the midsole 115 by adhesives, insert molding, or another suitable means and technique to attach the support structure 102 to the midsole 115.

In some examples, the medial strap 110 may include a low-friction material disposed on at least a back side 167 of the anterior sub-strap 112 and posterior sub-strap 113 of the medial strap 110 to improve sliding movement of the medial strap 110 when the first lace 152 of the first closure system 133 is being tightened. For instance, the low-friction material may allow the medial strap 110 to slide against the outer surface 155 of the upper 104 to prevent the outer surface material from bunching and causing discomfort to the wearer. When the first lace 152 of the first closure system 133 is tightened, the medial strap 110 and the lateral strap 108 may be cinched and secured to the upper 104 in an engaged position. This may provide increased lateral stability. Alternatively, when the first lace 152 is slack, the medial strap 110 and/or the lateral strap 108 may arc laterally outward from the upper 104.

As mentioned above, in some embodiments, the shoe 100 may include a second closure system 122 that may further secure a wearer's foot within the upper 104. The second closure system 122 may be proximate the eyestay 107 as can be seen in FIGS. 1A, 1B, and 1D. The second closure system 122 may be utilized at least in part to secure the upper 104 around the wearer's foot by controlling closure of the throat 114 around the wearer's foot. For instance, the second closure system 122 may enable the throat 114 opening to be enlarged to facilitate placement of a wearer's foot within the upper 104 of the shoe 100 and then to be closed around the wearer's foot. The second closure system 122 may sometimes referred to herein as a throat closure system. In some examples, the second closure system 122 is implemented as an adjustable lacing system, such as a BOA closure system described above. For instance, in some examples, the shoe 100 may include two adjustable lacing systems, where the first closure system 133 is a first adjustable lacing system and the second closure system 122 is a second adjustable lacing system.

In some examples, the second closure system 122 may include an adjustable lacing system that uses at least one lace (e.g., second lace 172) an adjustable dial (e.g., second adjustable dial 174), and lace guides (e.g., second lace guides 176). The second lace 172 may be selectively adjusted using the second adjustable dial 174. Increasing the tension may result in a tightening of the second lace 172 and decreasing the tension may result in a loosening of the second lace 172. The tension of the second lace 172 may be decreased using the second adjustable dial 174 to allow a wearer to place their foot at least partially within the upper 104. The wearer may use the second adjustable dial 174 to increase tension to the second lace 172 in order to tighten the second lace 172 and secure the upper 104 around the wearer's foot. The second lace 172 may be secured in any way now known or later developed. In some examples, the second lace 172 may be secured by tying ends of the second lace 172 to one another. The second lace 172 may be a tensile lace. In some examples, the second lace 172 is a wire. When a tension of the second lace 172 is increased, the second lace 172 may aid in securing the upper 104 around the wearer's foot.

The second lace guides 176 may be loops that allow the second lace 172 to slide through the loop when tension is increased or decreased using the second adjustable dial 174. In some examples, the second lace guides 176 are low friction. The second lace guides 176 may be coupled to the upper 104 at strategic points to help secure the upper 104 to the wearer's foot. The second lace guides 176 may be strategically placed such that when tightened, the second lace 172 does not cause the wearer discomfort. The placement of the second lace guides 176 may assist in stabilizing the foot. In some examples, the second closure system 122 and placement of the second lace guides 176 may attenuate forces acting on a wearer's foot such as pressure, shear force, ground forces, or the ability for flexion or movement.

As shown in FIGS. 1A, 1B, and 1C, in some examples, the second lace 172 may be above the upper 104 and configured to interact with an outer/exterior surface 155 of the upper 104, such as the outer/exterior surface of the eyestay 107. The second lace 172 may be entirely or partially visible. In other examples, the second lace 172 may be between exterior surface 155 of the upper 104 and the interior surface 145 of the upper 104. In such examples, there may be a channel for the second lace 172 between the exterior surface 155 of the upper 104 and the interior surface 145 of the upper 104. The second lace guides 176 may also be positioned between the exterior surface 155 of the upper 104 and the interior surface 145 of the upper 104.

In some examples, a portion of the second lace 172 may be between the exterior surface 155 of the upper 104 and the interior surface 145 of the upper 104, and another portion of the second lace 172 may be above the exterior surface 155 of the upper 104. In examples where at least a portion of the second lace 172 is above the exterior surface 155 of the upper 104, the upper 104 may optionally have grooves (not shown herein) for facilitating the placement of the second lace 172 when the second adjustable dial 174 is tightened. The grooves may secure the second lace 172 when the second adjustable dial 174 is tightened and prevent the second lace 172 from slipping or being tightened at an undesired location that may affect forces acting on the shoe 100 or a wearer's foot. The grooves may also provide a reliable position for the second lace 172 such that a wearer would not need to readjust the second lace 172.

In some examples, the second adjustable dial 174 may be coupled to the upper 104 proximate the eyestay 107. As depicted in FIGS. 1A, 1B, and 1D, in some examples, the second adjustable dial 174 may be coupled to the tongue 109. In other examples, the second adjustable dial 174 may be coupled to the upper 104 at an anterior side, medial side, or lateral side of the eyestay 107.

In some examples, and is as shown in FIGS. 1A, 1B, and 1D, at least one second lace guide 176 may be attached to or proximate the eyestay 107. In some examples, at least one second lace guide 176 may be attached to or proximate a medial side of the eyestay 107, and at least one second lace guide 176 may be attached to or proximate a lateral side of the eyestay 107. In some examples and as depicted in FIG. 1D, another second lace guide 176 may be attached to or proximate an anterior side of the eyestay 107. The second lace 172 may be coupled at both ends to the second adjustable dial 174.

It will be appreciated that in other examples, the second closure system 122 may include a variety of alternative fastening mechanisms, such as a tied lace, an elasticized lace, a band with a hook and loop closure, an elastic buckle, a button, a hook, a snap, or any other fastening device now known or later developed. It will be further appreciated that in further examples, the shoe 100 may not include a second closure system 122.

As shown in FIG. 4B, the medial strap 110 may extend medially under the midfoot region 135 below the insole 117, and upward along the outer/exterior surface 155 of the medial side of the upper 104 for engagement with the lateral strap 108 and further engagement with the first closure system 133. For instance, rather than extending upward along the interior surface 145 of the medial side of the upper and outwardly from the upper 104, in the depicted embodiment, the medial strap 110 may be configured to interact with the outer surface of the upper 104 from the bite line 165. This may allow for the free end of the lateral strap 108 to be pulled inwardly toward the medial side of the shoe 100, over the top of the midfoot region 135, and downward over the medial side of the upper 104. Thus, the angles at which the pull force of the lateral strap 108 are directed may be modified.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present technology.

It also should be understood the terms, "first", "second", "third", "fourth", "fifth", "sixth", "seventh", "eight", "ninth", "tenth", "eleventh", "twelfth", "top", "bottom", "upper", "lower", "upwardly", "downwardly", "right", "left", "center", "middle", "proximal", "distal", "anterior", "posterior", "forefoot", "mid-foot", and "rear-foot", and the like are arbitrary terms used to refer to one position of an element based on one perspective and should not be construed as limiting the scope of the technology.

All patents, publications, test procedures, and other references cited herein, including priority documents, are fully incorporated by reference to the extent such disclosure is not inconsistent with this technology and for all jurisdictions in which such incorporation is permitted. It is understood that the shoe materials, designs, constructions, and structures; shoe components; and shoe assemblies and sub-assemblies described and illustrated herein represent only some embodiments of the technology. It is appreciated by those skilled in the art that various changes and additions can be made to such products and materials without departing from the spirit and scope of this invention. It is intended that all such embodiments be covered by the appended claims.

What is claimed is:

1. A golf shoe comprising:

an upper;

a sole connected to the upper at a bite line, the sole comprising an outsole and an insole, wherein the upper and sole each have a forefoot, midfoot, and heel regions, a lateral side, a medial side, an anterior end, and a posterior end; and a midfoot support system, comprising a lateral strap and a medial strap, wherein:

the lateral strap is fixedly attached to the medial side of the outsole and extends between the insole and the outsole from the medial side of the insole to the lateral side of the insole;

the medial strap is fixedly attached to the lateral side of the insole and configured to extend under a wearer's foot;

the lateral strap and the medial strap are configured to wrap around the wearer's foot and connect; and the midfoot support system is configured for tension of the midfoot support system to be increased and decreased and such that, when the tension of the midfoot support system is increased, the midfoot support system provides asymmetrical support of the wearer's foot by drawing the lateral side of the wearer's foot against the lateral side of the golf shoe.

2. The golf shoe of claim 1, wherein the midfoot support system is configured such that, when the tension of the midfoot support system is increased:

the medial strap applies a first pull force vector that manipulates the wearer's foot to the bite line on the lateral side of the golf shoe; and the lateral strap applies a second pull force that crosses the first pull force vector.

3. The golf shoe of claim 1, wherein:

the lateral strap comprises a first end and a second end; and the lateral strap extends from the bite line on the lateral side of the golf shoe, upwardly along an exterior surface of the lateral side of the upper, and over at least a portion of the midfoot region of the upper to the second end of the lateral strap.

4. The golf shoe of claim 3, wherein the first end of the lateral strap is:

fixedly attached along a medial edge of the outsole; or fixedly attached along a substantial portion of a surface of the outsole in contact with the insole.

5. The golf shoe of claim 3, wherein:

the medial strap comprises a first end and a second end;

the first end of the medial strap is fixedly attached to a lateral edge of the insole;

the medial strap is configured to extend from the lateral edge to the medial side of the insole under the wearer's foot; and the medial strap extends along the insole from the lateral side to the medial side of the insole and upwardly along the medial side of the upper and through the second end of the lateral strap.

6. The golf shoe of claim 5, wherein the second end of the lateral strap includes at least one ring through which the medial strap is received.

7. The golf shoe of claim 6, wherein the medial strap is inserted from a bottom side of the at least one ring, folds transversely of a length of the medial strap and back on the medial strap to attach to a closure system of the midfoot support system.

8. The golf shoe of claim 3, wherein the lateral strap comprises a support structure configured to further stabilize at least the portion of the upper.

9. The golf shoe of claim 8, wherein the support structure is substantially L-shaped, comprising:

a lower portion located proximate to the first end of the lateral strap extending to the lateral side of the insole; and an upper portion extending from the lateral side upwards along a portion of the exterior surface of the lateral side of the upper.

10. The golf shoe of claim 8, wherein the lateral strap is made from a first material and the support structure is made from a second material, the second material being more rigid than the first material.

11. The golf shoe of claim 1, wherein the midfoot support system further comprises an adjustable closure system coupled to the medial strap, wherein the closure system engages the medial strap when the tension of the closure system is increased, causing a tension of the medial strap and the lateral strap to increase.

12. The golf shoe of claim 11, wherein the closure system comprises a lace, lace guides, and an adjustable dial.

13. The golf shoe of claim 11, wherein the closure system comprises at least one of a ratchet or a hook-and-loop fastener.

14. The golf shoe of claim 11, further comprising a second closure system configured to close a throat of the shoe.

15. A golf shoe comprising:

an upper;

a sole connected to the upper at a bite line;

a lateral strap, wherein:

the lateral strap comprises a first end fixedly attached to a medial side of the sole;

the lateral strap is fixedly connected to the sole from the first end of the lateral strap to a lateral side of the sole;

from the lateral side of the sole, the lateral strap extends outward from the bite line and upwards along a lateral side of the upper and over at least a portion of a midfoot region of the upper to a second end; and the second end of the lateral strap comprises a ring;

a medial strap, wherein:

the medial strap comprises a first end fixedly attached to the lateral side of the sole;

from the first end of the medial strap, the medial strap is configured to extend under a wearer's foot to the medial side of the sole and upwards along the upper; and a second end of the medial strap extends from the upper, through the ring of the lateral strap, and towards an exterior medial surface of the upper; and a tension adjustment element coupled to the second end of the medial strap and configured such that adjustment of the tension adjustment element causes a pulling force on the second end of the medial strap that provides asymmetrical support of the wearer's foot by drawing a lateral side of the wearer's foot against a lateral side of the shoe.

16. The golf shoe of claim 15, wherein:

the second end of the medial strap is split into a posterior sub-strap and anterior sub-strap; and the ring of the lateral strap is a first ring and the lateral strap further comprises a second ring, the first ring receiving the posterior sub-strap and the second ring receiving the anterior sub-strap.

17. The golf shoe of claim 15, wherein the tension adjustment element is one of an adjustable dial or a ratchet.

18. The golf shoe of claim 15, wherein the lateral strap includes a support structure comprising:

a lower portion located proximate to the first end of the lateral strap extending to the lateral side of the sole; and an upper portion extending from the lateral side upwards along a portion of an exterior surface of the lateral side of the upper, where the lateral strap is made from a first material and the support structure is made from a second material, the second material being more rigid than the first material.

19. A golf shoe comprising:

an upper;

a sole connected to the upper at a bite line;

a lateral strap made from a first material, the lateral strap comprising:

a first end attached at least along a portion of a medial side of the sole;

a second end extending from the bite line and upwards over a lateral side of a midfoot region of the shoe; and a support structure, positioned within the lateral strap, made from a second material that is more rigid than the first material, the support structure comprising:

a lower portion located proximate to the first end of the lateral strap extending to the lateral side of the sole; and an upper portion extending from the lateral side of the sole upwards along a portion of the lateral side of the upper, the upper portion being spaced apart from a medial side of the shoe; and a medial strap comprising:

a first end attached to a lateral side of the sole; and a second end configured to extend under a wearer's foot to the medial side of the sole, upwards along a medial side of the midfoot region of the shoe, through the second end of the lateral strap, and back towards the medial side of the midfoot region.

20. The golf shoe of claim 19, further comprising a tension adjustment element coupled to the second end of the medial strap and configured such that adjustment of the tension adjustment element causes a pulling force on the second end of the medial strap that provides asymmetrical support of the wearer's foot by drawing a lateral side of the wearer's foot against a lateral side of the shoe.

* * * * *